United States Patent [19]

Bailey et al.

[11] Patent Number: 4,962,819

[45] Date of Patent: Oct. 16, 1990

[54] MUD SAVER VALVE WITH REPLACEABLE INNER SLEEVE

[75] Inventors: Thomas F. Bailey; Raymond A. Todd, Jr., both of Houston, Tex.

[73] Assignee: Drilex Systems, Inc., Houston, Tex.

[21] Appl. No.: 305,213

[22] Filed: Feb. 1, 1989

[51] Int. Cl.[5] ..... E21B 21/10; F21K 51/00

[52] U.S. Cl. ..... 175/218; 137/327; 166/322; 166/325; 251/357; 251/368

[58] Field of Search ..... 166/319, 322, 325; 175/218, 232; 137/68.1, 71, 327, 493.2, 493.9, 496, 508; 251/357, 368

[56] References Cited

U.S. PATENT DOCUMENTS

| | | | |
|---|---|---|---|
| 3,698,426 | 10/1972 | Litchfield et al. | 166/325 |
| 3,757,816 | 9/1973 | Price | 251/368 |
| 3,965,980 | 6/1976 | Williamson . | |
| 3,967,679 | 7/1976 | Liljestrand . | |
| 4,128,108 | 12/1978 | Parker et al. | 137/327 |
| 4,196,886 | 4/1980 | Murray | 251/357 |
| 4,364,407 | 12/1982 | Hilliard | 175/218 |
| 4,625,755 | 12/1986 | Reddoch | 137/327 |
| 4,658,905 | 4/1987 | Burge | 166/373 |
| 4,705,062 | 11/1987 | Baker | 251/368 |
| 4,779,688 | 10/1988 | Baugh | 175/218 |

*Primary Examiner*—Bruce M. Kisliuk

*Attorney, Agent, or Firm*—Edgar A. Zarins; Malcolm L. Sutherland

[57] ABSTRACT

A mud saver valve for insertion within the drill string to retain mud in the drill pipe and prevent the mud column from flowing past the valve when pumping is interrupted. The valve body has a tubular body and a piston having an axial passage for the flow of drilling mud. This piston is biased within the body by a spring and axially movable in response to the mud flow. A check valve plug is disposed within the bore which may be removed to run wireline tools. The plug is seated within a reduced diameter portion of the body and includes a replaceable inner sleeve which engages the piston to prevent flow through the valve. The inner sleeve is replaced as it becomes worn due to the erosive forces of the drilling mud.

14 Claims, 2 Drawing Sheets

MUD SAVER VALVE WITH REPLACEABLE INNER SLEEVE

BACKGROUND OF THE INVENTION

I. Field of the Invention

This invention relates to mud saver valves which allows the downward flow of drilling mud but closes when pumping is interrupted to retain the mud within the drill string and, in particular, to a mud saver valve with an inner sleeve which is replaceable when worn in order to ensure sealing engagement with the piston.

II. Description of the Prior Art

In the drilling of oil and gas wells, it is common practice to insert in the drill string between the kelly and the drill pipe a valve to retain mud in the kelly when the drill string is detached. The advantages of mud saver valves include saved mud costs, decreased chances of pollution, and increased safety to rig personnel. Many of the past known mud saver valves include a piston having an axial throughbore biased upwardly within the valve housing by a spring. When closed, the piston engages a closure plug which blocks mud flow through the piston. As the surface pumps pump drilling mud through the drill string, the fluid pressure acts against the top of the piston and the force of the spring to open the fluid passageway through the valve. When mud flow is interrupted, the spring forces the piston against the closure plug to close the passageway.

The closure plug is removably mounted within the upper end of the valve housing to permit the running of wireline tools through the drill string. Typically, the closure plug is provided with a spear head such that an overshot may be run to grasp the plug for removal. Many of the past known closure plugs also include a check valve to bleed off excess downhole fluid pressure when the valve is closed.

As the pumping pressure increases the piston is forced downwardly to permit mud flow past the closure member and through the piston passageway. Because of the abrasive properties of the drilling mud, the lower end of the closure plug can become eroded and worn resulting in an insufficient seal between the closure plug and the piston. The upper edge of the piston can also become worn due to the flow of the drilling mud. Past known mud saver valves have provided the upper end of the piston with a wear-resistant member which can be replaced. However, because of the construction of past known closure plugs, in the event the plug became worn causing leakage either the valve would have to be discarded or the entire closure plug would have to be replaced.

SUMMARY OF THE PRESENT INVENTION

The present invention overcomes the disadvantages of the prior known mud saver valves by providing a replaceable inner sleeve which receives the removable closure plug and engages the piston to close the valve.

The mud saver valve of the present invention includes a tubular housing insertable within the drill string and housing a spring-biased piston having an axial fluid passageway. Removably secured within the top of the housing is a closure plug with a spearhead. The closure plug seats within a replaceable inner sleeve the bottom end of which engages the piston to prevent fluid flow through the valve. The closure plug includes a check valve to bleed excess downhole fluid pressure. The inner sleeve is retained within the top of the housing by a series of bolts which have shearable ends that engage and retain the closure plug. When it becomes necessary to remove the closure plug to run wireline tools, the spearhead is grasped by an overshot tool and pulled from within the inner sleeve.

As the bottom end of the inner sleeve becomes worn due to erosion from the flowing drilling mud, the sleeve can be removed from the housing after removal of the bolts. In order to increase the useful life of the sleeve, the bottom end of the sleeve can be provided with a carbide or polyurethane cap or the carbide material can be sprayed directly onto the end of the sleeve. Nevertheless, when the inner sleeve becomes eroded, the mud saver valve can be repaired at a minimum of cost and repair time.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
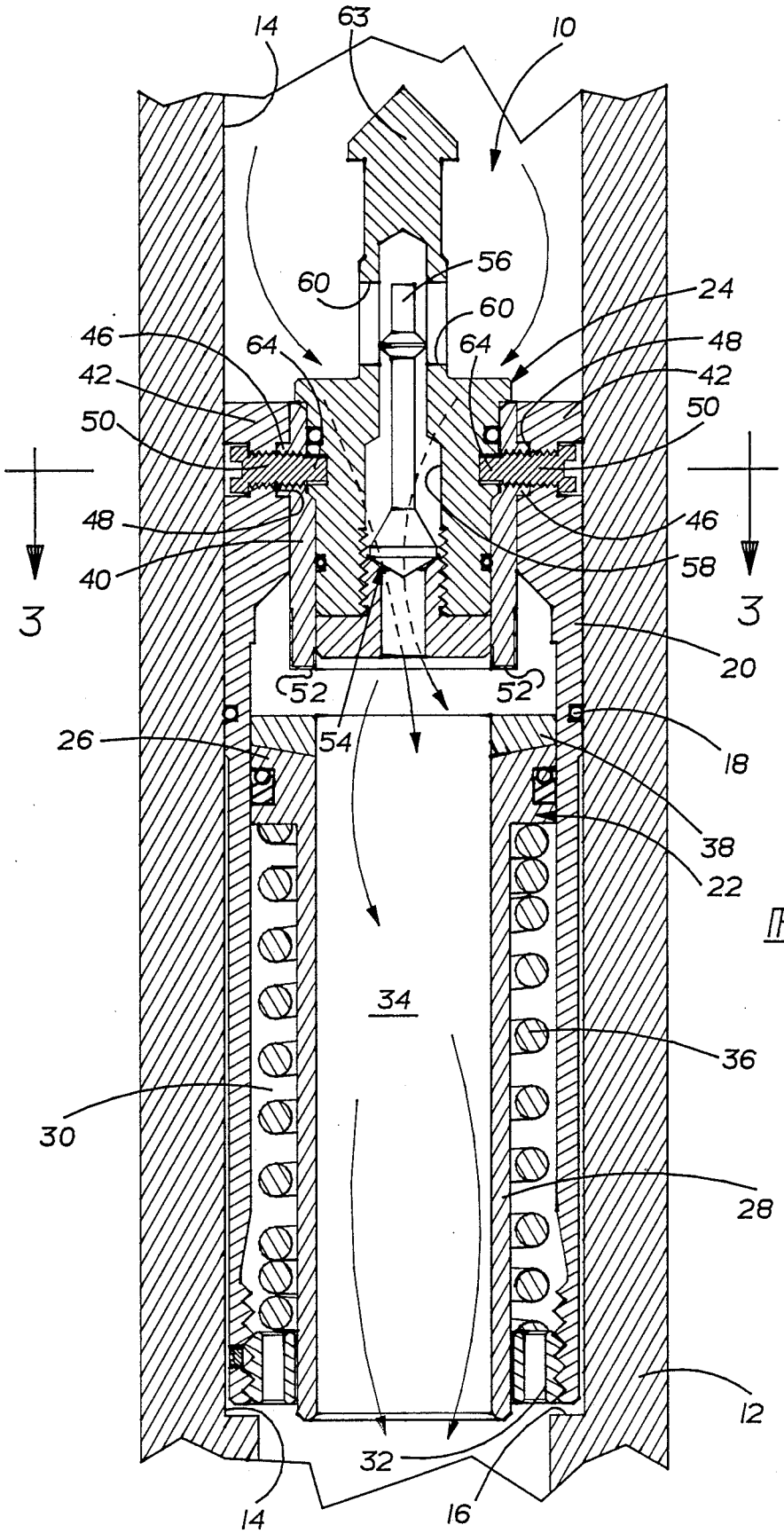
FIG. 1 is a cross-sectional perspective of a mud saver valve embodying the present invention with drilling mud flowing down through the valve.

Referring to the drawing, there is shown a mud saver valve 10 embodying the present invention and disposed within a section of drill string 12 below the kelly drive. In a preferred embodiment, the mud saver valve 10 is retained within a radially enlarged portion 14 of a kelly saver sub and is supported upon a radial shoulder 16. The mud saver valve 10 is provided with outer seals 18 to prevent drilling mud from flowing past the mud saver valve 10. The mud saver valve 10 of the present invention is designed to allow drilling mud to be pumped down through the drill string 12 to operate drilling tools and the like farther in the hole. However, upon interruption of mud pumping, the mud saver valve 10 closes to prevent the column of drilling mud from flowing out of the string above the valve 10 possibly threatening the environment or the safety of the rig personnel.

Disposed within the annulus 30 is a compression spring 36 to bias the piston 22 upwardly against the flow of the pumped drilling mud. The spring 36 extends between the retainer ring 32 and the piston head 26 to bias the piston 22 away from the retainer ring 32 and the lower end of the tubular housing 20. The upper surface of the piston 22 may be provided with a replaceable wear-resistant ring 38 to withstand the erosive forces of the drilling mud flowing past the piston 22 into the passageway 34.

Figure 3:
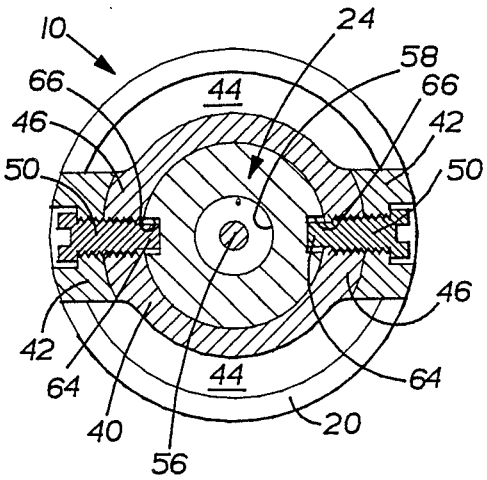
FIG. 3 is a cross-sectional view taken along lines 3—3 of FIG. 1.

Cooperating with the piston 22 to close the mud saver valve 10 is an inner sleeve 40 which is supported in the upper end of the tubular housing 20. In a preferred embodiment of the invention, the tubular housing 20 has a pair of support arms 42 extending upwardly from the main portion of the housing 20. The support arms 42 separate a pair of flow paths 44 (FIG. 3) which direct drilling mud around the inner sleeve 40 to engage the piston 22 as will be subsequently described. The inner sleeve 40 is provided with a pair of outwardly extending flanges 46 which are received by corresponding slots 48 in the support arms 42 of the housing 20 to prevent axial movement of the inner sleeve 40 unless the flanges 46 are rotated out of the slots 48. The inner sleeve 40 is fixedly retained within the upper end of the housing 20 by retaining bolts 50 which extend through the support arms 42 to engage the sleeve 40 at the flanges 46. In a preferred embodiment, the bolts 50 extend through the inner sleeve 40 to engage the closure plug 24. The lower end of the inner sleeve 40 engages the piston 22 and is exposed to the flow of drilling mud between the piston 22 and the sleeve 40. In order to reduce wear on the lower end of the inner sleeve 40 a protective coating or cap 52 is applied. The coating or cap 52 is preferably made of carbide or polyurethane although other materials could be used to reduce erosion of the inner sleeve 40. Nevertheless, when the inner sleeve 40 does become excessively worn so that a proper closing seal with the piston 22 cannot be maintained, the inner sleeve 40 can be removed and replaced in accordance with the present invention.

Figure 2:
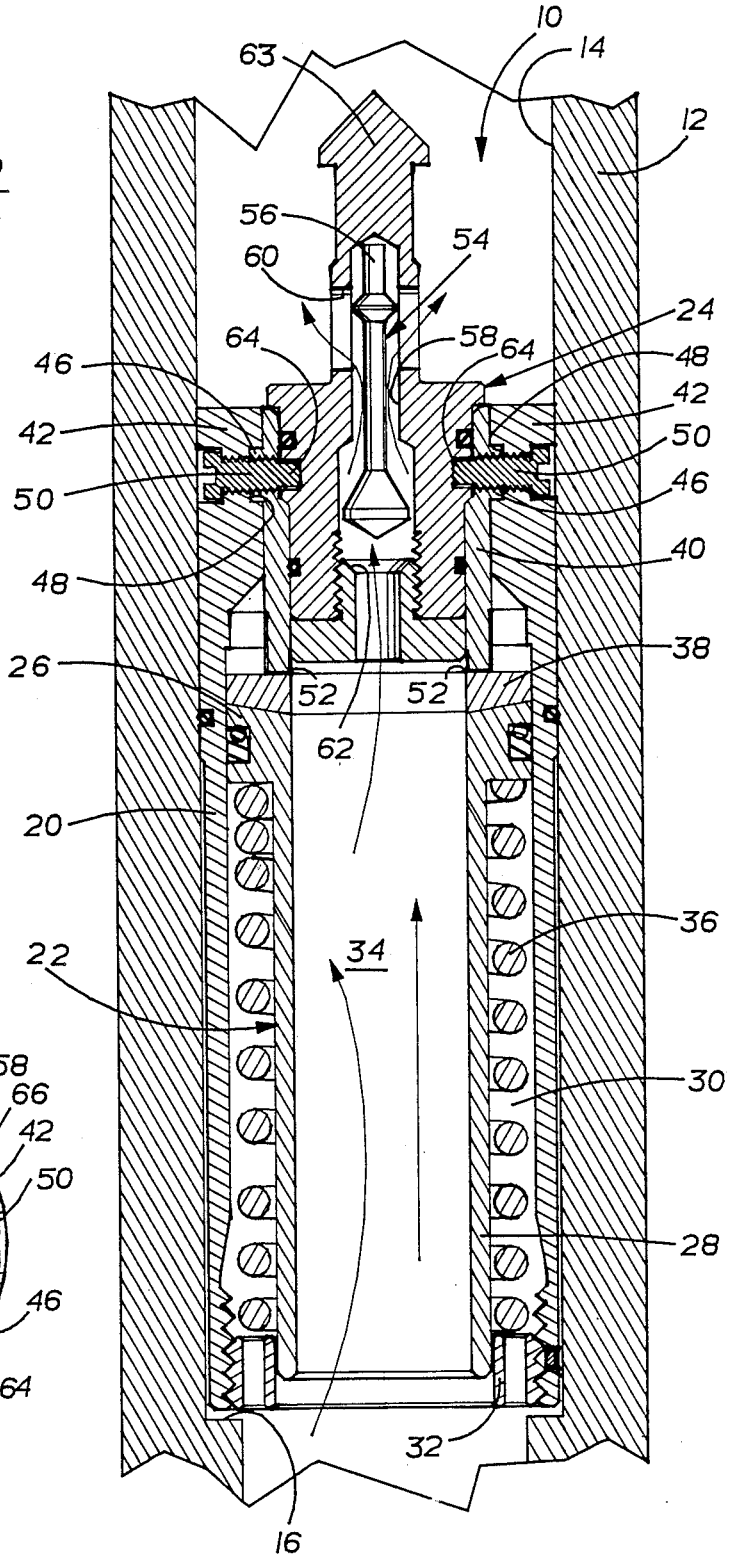
FIG. 2 is a cross-sectional perspective of the mud saver valve with the check valve open to bleed downhole fluid pressure.

Seated within the inner sleeve 40 is a closure plug 24 having check valve means 54 to relieve or bleed off any excess fluid pressure downhole of the mud saver valve 10 when the valve 10 has been closed. By allowing the excess pressure to be relieved through the check valve means 54, a pressure build-up will not inadvertently blow out the closure plug 24. The check valve 54 illustrated includes a valve stem 56 axially movable within bore 58 of the closure plug 24. The bore 58 is open to the bottom of the closure plug 24 in order to communicate with the fluid passageway 34. A pair of fluid ports 60 are formed near the top of the closure plug 24 to provide fluid communication between the bore 58 and the interior of the string 12. Thus, when fluid pressure downhole of the mud saver valve 10 builds up, the pressure will overcome the weight of the valve stem 56 to raise the stem 56 away from the valve seat 62 allowing the fluid to flow through the bore 58 of the check valve 54 as shown in FIG. 2. Of course, the check valve means 54 shown and described herein is an example of one type of check valve which could be utilized in the present invention and it is to be understood that other types of check valves could be used to relieve fluid pressure.

The closure plug is removably seated within the inner sleeve 40 supported in the upper end of the tubular housing 20. The closure plug 24 is removable in the event it becomes necessary to run wireline tools through the mud saver valve 10. The closure plug 24 is provided with a spear head 63 adapted to engage an overshot tool. The closure plug 24 is fixedly retained within the inner sleeve 40 by the retaining bolts 50. The bolts 50 include a shearable end portion 64 which engages the closure plug 24. The end portons 64 are received within cavities 66 formed in the closure plug 24. Alternatively, separate shear screws may be provided to retain the closure plug 24 within the inner sleeve 40. To remove the closure plug 24, an overshot tool is run into the string 12 to engage the spear head 63. An upward tension force is applied to the closure plug 24 until end portions 64 of retaining bolts 50 shear away freeing the closure plug 24. Upon removal of the closure plug 24 an axial throughbore is formed through which the wireline tools can be run.

Operation of the mud saver valve 10 embodying the present invention permits the flow of drilling mud downhole through the drill string 12 to operate drilling tools but closes to retain the column of drilling mud when pumping of the mud is interrupted. The valve 10 is run into the enlarged portion 14 of the kelly sub until it engages the shoulder 16 where it is retained in position by the frictional engagement between the body 20 and seal 18 and the sub walls. With the valve 10 positioned in the drill string 12, downhole pumping of drilling mud can be initiated. As the mud flows down past the closure plug 24 and inner sleeve 40 through paths 44, the mud will engage the top of the piston 22 which is at first biased against the lower end of inner sleeve 40. The pumping pressure of the mud will force piston 22 downwardly against the force of the spring 36 opening a gap (FIG. 2) between the lower end of the sleeve 40 and the piston 22 and allowing the drilling mud to flow through the passageway 34. The size of the gap formed between the piston 22 and the sleeve 40 will depend upon the pumping pressure and flow of the drilling mud and upon the compression force of the spring 36 which can be changed to alter the operation of the valve 10.

When pumping of the drilling mud is interrupted, the force of the spring 36 will bias the piston 33 against the lower end of the inner sleeve 40 to prevent the drilling mud from flowing past the closure plug 24 into the passageway 34 while also preventing upward flow of mud past the closure plug 24. However, in the event fluid pressure below the valve 10 builds up or, upon interruption of mud pumping, a sudden upward surge of drilling mud due to downhole pressures occurs, the check valve 54 of the closure plug 24 will bleed or relieve this pressure. As a result, the closure plug 24 is prevented from being inadvertently blown out of the inner sleeve 40.

Because of the abrasive and erosive nature of the drilling mud, as the mud flows through the gap formed between the inner sleeve 40 and the piston 22 both surfaces can be worn down. To reduce the wear caused by the drilling mud the piston head 26 can be provided with a wear ring 38 and the lower end of the inner sleeve 40 can be provided with a protective coating 52 since these surfaces are subjected to the greatest erosive effect of the drilling mud. Nevertheless, the protective cap or coating 52 of the inner sleeve 40 will eventually be worn away causing wear on the inner sleeve 40 and destroying the sealing cooperation of the piston 22 and inner sleeve 40. The present invention provides a replaceable inner sleeve 40 which can be removed and replaced with a new sleeve 40. The retaining bolts 50 are removed allowing rotation of the sleeve 40 until the flanges 46 are removed from the slots 48. The sleeve 40 can now be removed and replaced. Once the new inner sleeve 40 is in position, the retaining bolts 50 can be inserted until the closure plug 24 is engaged. Thus, when the sleeve 40 becomes worn only the sleeve needs to be replaced thereby reducing manufacturing costs and downtime.

The foregoing detailed description has been given for clearness of understanding only and no unnecessary limitations should be understood therefrom as some modifications will be obvious to those skilled in the art without departing from the scope and spirit of the appended claims.

I claim:

1. In a mud saver valve for retaining drilling mud within a drill string when downhole pumping of the mud is interrupted, the mud saver valve including a tubular housing adapted to be received within the drill string, the housing receiving an upwardly biased, axially movable piston having a fluid passageway to permit the flow of fluids through the valve when the mud is being pumped downhole and a closure plug removably received within the upper end of the mud saver valve, the closure plug including check valve means to permit the upward flow of mud through the mud saver valve to relieve downhole fluid pressure, the improvement comprising:

a selectively replaceable inner sleeve supported within the upper end of the mud saver valve by at least one retaining bolt and matingly receiving the removably closure plug, said inner sleeve including a lower end engageable with the piston to prevent the flow of fluid through the fluid passageway.

2. The improved mud saver valve as defined in claim 1 wherein said lower end of said inner sleeve includes coating means for resisting erosion of said inner sleeve as the fluid flows past said lower end of said sleeve into the fluid passageway.

3. The improved mud saver valve as defined in claim 2 wherein said coating means comprises a cap member mounted to said lower end of said inner sleeve, said cap member being made of an erosion resistant material.

4. The improved mud saver valve as defined in claim 1 wherein said inner sleeve is retained within the upper end of the tubular housing by said at least one retaining bolt extending from the tubular housing to engage said inner sleeve, said inner sleeve being removable from the upper end of the tubular housing upon removal of said at least one retaining bolt.

5. The improved mud saver valve as defined in claim 4 wherein said at least one retaining bolt includes a shearable end portion, said shearable end portion engaging the closure plug such that said end portion is sheared when an upward force is applied to the closure plug to remove the plug from within said inner sleeve.

6. In a mud saver valve for retaining well fluids within a drill string when downhole pumping of the fluid is interrupted, the mud saver valve including a tubular housing adapted to be received within the drill string, the housing receiving an axially movable piston biased upwardly by a spring and having a fluid passageway to permit the flow of fluids through the valve when the fluid is being pumped downhole and a closure plug removably supported within the upper end of the tubular housing, the closure plug including check valve means to permit the upward flow of mud through the mud saver valve to relieve downhole fluid pressure when the piston is biased upwardly, the improvement comprising:

a replaceable inner sleeve supported within the upper end of the mud saver valve and matingly receiving the removable closure plug, said inner sleeve retained within the upper end of the mud saver valve by at least one retaining bolt extending from the tubular housing to engage said inner sleeve, said inner sleeve including a lower end engageable with the piston to prevent the flow of fluid through the fluid passageway, said lower end of said sleeve including coating means for resisting erosion of said inner sleeve as the fluid flows past said lower end of said sleeve.

7. The improved mud saver valve as defined in claim 6 wherein said at least one retaining bolt includes a shearable end portion, said shearable end portion engaging the closure plug such that said end portion is sheared when an upward force is applied to the closure plug to remove the plug from within said inner sleeve, said at least one retaining bolt remaining in engagement with said inner sleeve upon shearing of said end portion.

8. The improved mud saver valve as defined in claim 7 wherein said coating is in the form of a cap member attachable to said lower end of said inner sleeve.

9. The improved mud saver valve as defined in claim 6 wherein said erosion resistant coating is a carbide material.

10. A mud saver valve for retaining drilling mud within a drill string when downhole pumping of the mud is interrupted, said mud saver valve comprising:

a tubular housing adapted to be received in a radially enlarged portion of the drill string;

an axially movable piston mounted within said tubular housing and having a central fluid passageway, said piston biased upwardly against the downhole flow of drilling mud by a spring;

a selectively replaceable inner sleeve supported within the upper end of said tubular housing by a pair of retaining bolts extending from said tubular housing through said inner sleeve; said inner sleeve including a lower end engageable with said piston to prevent mud flow through said mud saver valve when pumping is interrupted, said piston biased into engagement with said lower end of said inner sleeve when pumping of drilling mud is interrupted; and a closure plug having check valve means seated within said inner sleeve, said closure plug being removable from said inner sleeve and tubular housing when an upward force is applied to said closure plug.

11. The mud saver valve as defined in claim 10 wherein said retaining bolts include a shearable end portion, said end portion engaging said closure plug to removably retain said closure plug within said inner sleeve.

12. The mud saver valve as defined in claim 10 wherein said lower end of said inner sleeve provided with an erosion resistant material to prevent wear on said inner sleeve as the drilling mud flows past the lower end of said inner sleeve.

13. The mud saver valve as defined in claim 12 wherein said erosion resistant material is an elastomer material.

14. The mud saver valve as defined in claim 12 wherein said erosion resistant material is a carbide material.

* * * * *